United States Patent [19]

Berne

[11] Patent Number: 4,796,449

[45] Date of Patent: Jan. 10, 1989

[54] AUTOMATICALLY CONTROLLED MACHINE FOR ROLLING METAL SHEETS

[75] Inventor: Jean G. Berne, Aix En Provence, France

[73] Assignee: Societe Nouvelle Des Ateliers Et Chantiers Du Havre, Le Havre, France

[21] Appl. No.: 947,719

[22] Filed: Dec. 30, 1986

[30] Foreign Application Priority Data

Dec. 30, 1985 [EP] European Pat. Off. ..... 85402653

[51] Int. Cl.[4] ..... B21D 5/14; B21D 7/14

[52] U.S. Cl. ..... 72/9; 72/17; 72/173

[58] Field of Search ..... 72/9, 12, 17, 173–175, 72/702

[56] References Cited

U.S. PATENT DOCUMENTS

| | | | |
|---|---|---|---|
| 173,689 | 2/1876 | Teal | 72/175 |
| 2,335,028 | 11/1943 | Rose et al. | 72/173 |
| 2,706,513 | 4/1955 | Linder | 72/175 |
| 3,854,215 | 12/1974 | Foster | 72/9 |
| 3,906,765 | 9/1975 | Foster | 72/9 |
| 4,047,411 | 9/1977 | Foster | 72/173 |
| 4,117,702 | 10/1978 | Foster | 72/173 |
| 4,615,199 | 10/1986 | MacLeod | 72/166 |

FOREIGN PATENT DOCUMENTS

| | | | |
|---|---|---|---|
| 3519382 | 12/1985 | Fed. Rep. of Germany | 72/173 |

*Primary Examiner*—Daniel C. Crane

*Attorney, Agent, or Firm*—Browdy & Neimark

[57] ABSTRACT

The machine incorporates at least two central rollers appropriately driven, and adjustable in height in order to disengage a finished object. In combination with the central rollers, side rollers are positioned in space by means of jacks. The positioning is permanently registered by sensors working in connection with a computer and probes positioned between the central rollers and the side roller for providing information compared to instructions from the computer in order to correctly position the side rollers.

5 Claims, 3 Drawing Sheets

AUTOMATICALLY CONTROLLED MACHINE FOR ROLLING METAL SHEETS

FIELD AND BACKGROUND OF THE INVENTION

Machines are already known for rolling very thick metal sheets or plates, particularly in shipbuilding, which machines generally incorporating four cylindrical rollers.

Two of the rollers, called the central rollers, are lying in a vertical plane and nip between themselves the sheet to be rolled, with a controllable effort. One of the rollers is mobile with respect to the other in a vertical plane by means of two cylinders that move it in such manner that the generating lines of the upper and lower central rollers are parallel. The feeding hydraulic pressure of the cylinders can vary and provides for the control of the nipping effort.

Moreover the nipping engagement provides for driving the metal sheet by friction lengthwise and in the horizontal plane, the two lower and upper central rollers being provided with rotation means such as an electric, hydraulic or other motor element.

Two other rollers, usually called side rollers, are placed symmetrically on both sides of the central rollers. They are mobile in a direction which is oblique with respect to the plane in which lie the axes of the two central rollers.

Two groups of hydraulic cylinders are attached to the side rollers, and are used for positioning separately in space the side rollers in altitude with respect to the pair of central rollers.

Of course, the aforementioned assembly of four rollers is incorporated in a support frame having all the slides necessary for the movements of the central and side rollers.

Moreover, the support frame is provided with a lateral rocking or tilting bearing articulated about an operation axis by a cylinder. This tilting bearing assembly is situated in the axis of a frame and is adapted for disengaging the upper central roller sliding bearing so as to be able to give, in the aforementioned assembly of four rollers, an entirely closed rolled metal sheet.

In present practice, the setting of the machine, and particularly setting of the position of the side roller forming the metal sheet theoretical radius, are controlled manually by an operator whose work, despite his experience, is satisfactory only after a long period of work. Consequently, the cost price is very high. This is also due to the fact that due to the non-homogeneities of the metal to be rolled, the metal sheet thickness variations due to laminating errors, the modifications of the metal characteristics during rolling, and the fact that the operation is carried out beyond the material resilient limit, it results on the one hand that the radius really obtained is not the one which is controlled and on the other hand that there is often found a really important evolution which evolution can be considered as variations between a maximum radius and a minimum radius really bound to each other. It is therefore necessary to make up for such errors by resorting to many lateral passes carried out at a reduced speed of the machine, with nevertheless a final result presenting non negligible faults.

This state of the prior art shows an insufficient quality of the work produced by the machine, despite an intervention of highly qualified experts.

Therefore, it has appeared necessary to remedy these major disadvantages in view of the very strict specification sheets recently in force in shipbuilding.

OBJECTS AND SUMMARY OF THE INVENTION

An object of the present invention is therefore to have a practically automatic control of the machine in order to obtain, from digital data and by a set of passes, correctly machined parts whatever the material faults and whatever the shape, cylindrical or frustoconical, desired for the metal sheet thus treated.

According to the invention, the automatically controlled machine for rolling metal sheets incorporates: at least two central rollers; means for rotating and adjustably driving the at least two central rollers with the metal sheet passing therebetween; side rollers placed on each side of the at least two central rollers; cylinders being provided for positioning in space the side rollers; a first set of sensors connected to the side rollers and to a computer for registering a position of the side rollers; at least one probe positioned between the at least two central rollers and the side rollers, the probes being connected to a second set of sensors and being made of cylinders having a stem provided with wheels rotating on the metal sheet passing out of the central rollers so as to obtain a position of the probes by means of the second set of sensors; the second set of sensors being connected to the computer for providing information compared to instructions from the computer in order to correctly position the side rollers for suitably rolling the metal sheet to a required radius within given tolerances.

According to another feature of the invention, one of the central rollers (lower roller) is mounted in bearings adapted for sliding vertically under the action of jacks for obtaining a constant and uniform effort from instructions worked out by the computer.

Various other features of the invention will become more apparent from the following detailed description.

BRIEF DESCRIPTION OF DRAWINGS

An embodiment of the object of the invention is shown by way of a non limiting example in the accompanying drawings, wherein.

DETAILED DESCRIPTION OF THE INVENTION

Figure 1:
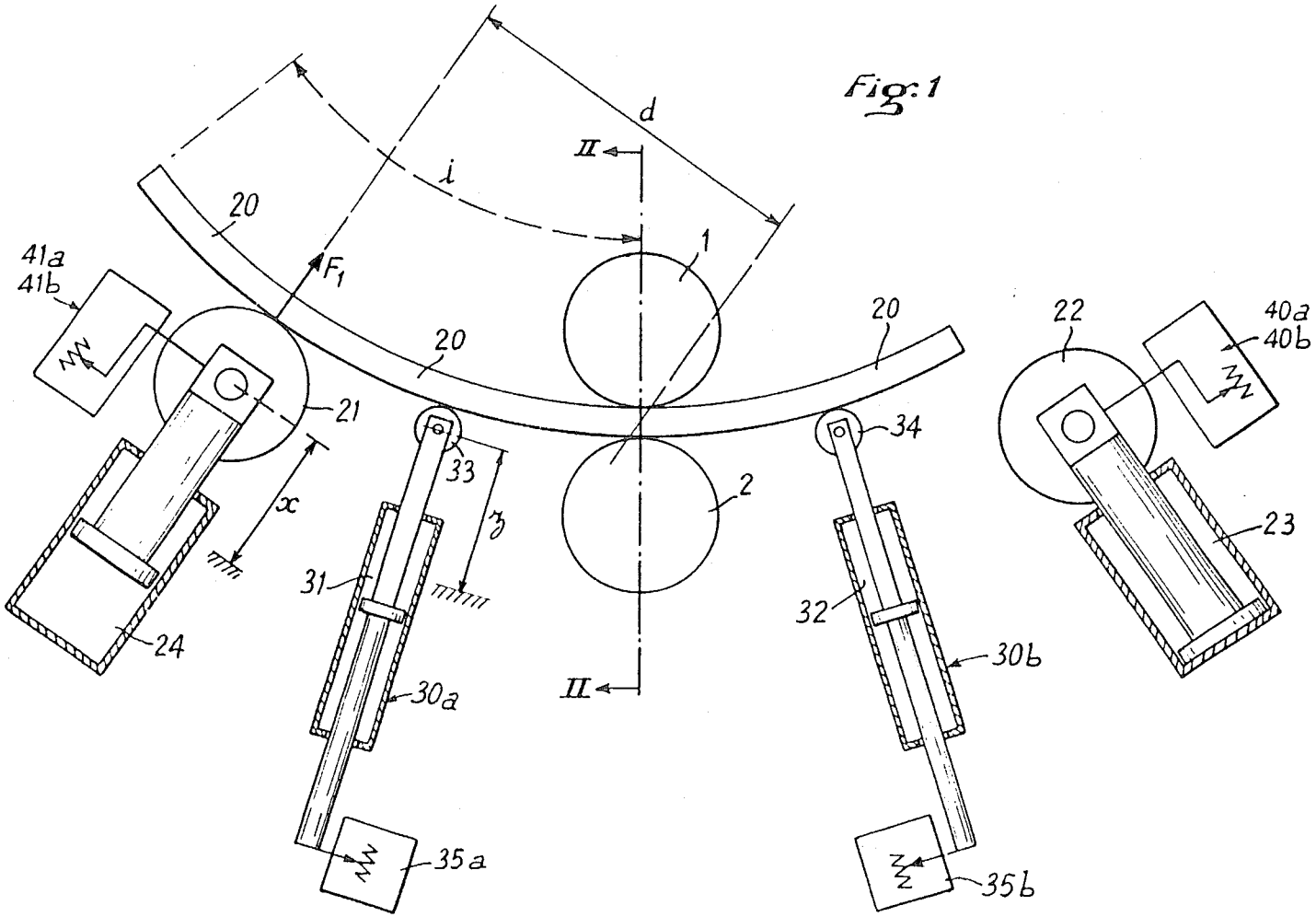
FIG. 1 is an elevation view, partly in schematic cross section, of the machine passes.
Figure 2:
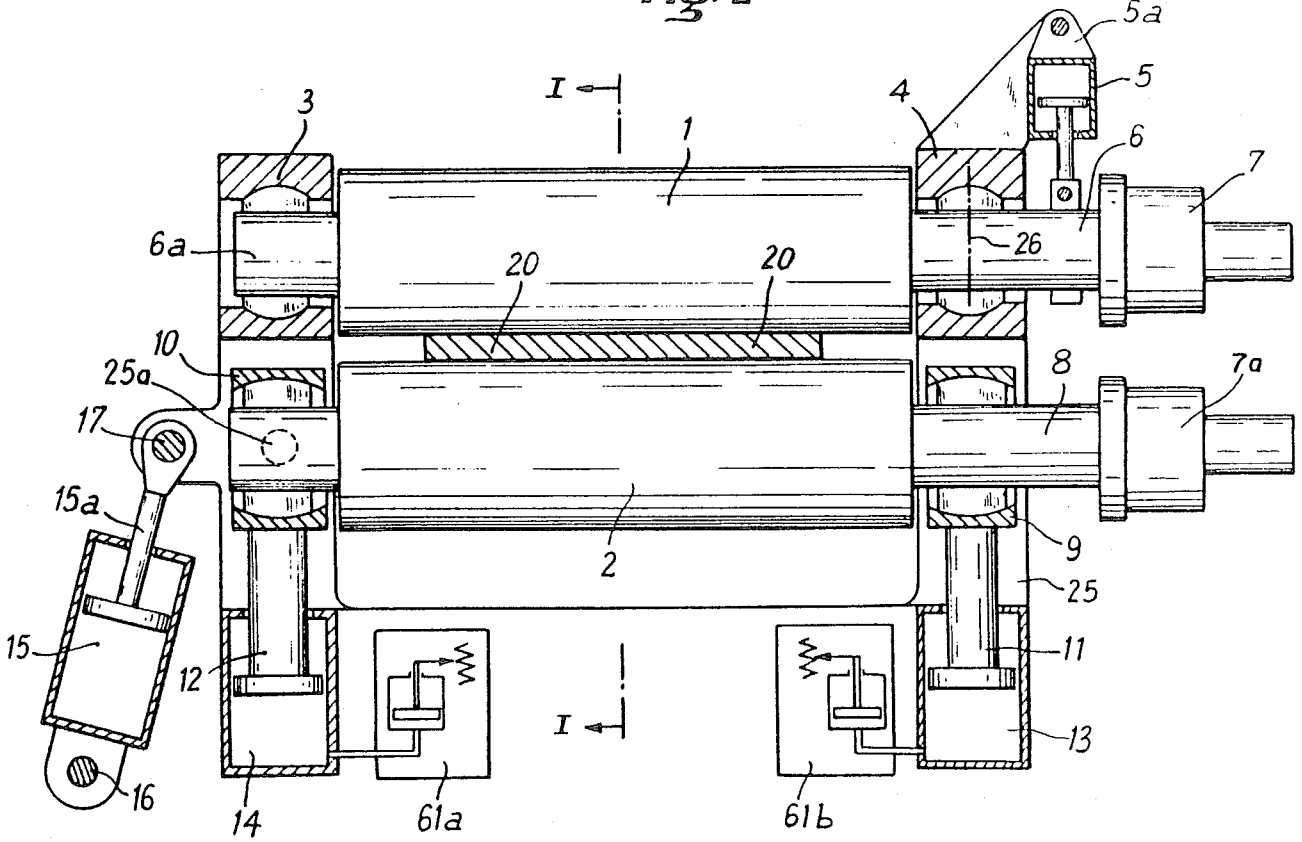
FIG. 2 is a sectional view along line II—II of FIG. 1.

In FIG. 1, which is a very schematic partial cross sectional view along line I—I of FIG. 2, there is shown two central rollers 1, 2, the roller 1 being called an upper roller and roller 2 being called a lower roller. The upper roller 1 is mounted in bearings 3, 4 (FIG. 2) rigidly connected to the machine frame, not shown, and calculated for resisting the efforts to which the upper roller 1 is subjected.

As it is better shown in FIG. 2, it is possible via a double action cylinder 5 to set the position of the bearing 4 in view of the operations to be described herebelow.

The upper roller 1 is mounted on a driving shaft 6 the ends of which are supported by bearings 3 and 4.

Moreover, one end of the driving shaft 6 carries a member 7 for connecting the shaft 6 to a motor element. The lower roller 2 is mounted, via a shaft 8, in bearings 9, 10 supported by the stems 11, 12 of double action cylinders 13, 14 rigidly connected to the machine frame. The lower roller 2 can thus be moved vertically via the bearings 9, 10 and shaft 8. A member 7a is further provided for connecting the shaft 8 to a motor element.

However and as in the present case, it is sometimes possible to drive the lower roller 2 by using cylinder 14.

Moreover, a double action cylinder 15, placed on the lateral side of the machine frame and articulated thereto, has an axis 16 rigidly connected to the machine frame and adapted for displacing the bearing 3 by its stem 15a and with assistance of a pivot axis 17, in order to disengage the upper roller 1 and bring it in an extraction position when the work passes are over in the ring made from a metal sheet 20.

The herabove description shows that the central rollers 1 and 2, lying in the same vertical plane, nip the metal sheet 20 to be rolled with a proportionable effort since this effort is a function of the pressure of the cylinder stems 11, 12 displacing the lower central roller 2 so that the generating lines of the rollers is always parallel. The feeding hydraulic pressure of the double action cylinders 13, 14 can easily vary and therefore can control the nipping effort exerted on the metal sheet 20. Moreover, the nipping effort thus obtained enables the sheet 20 to be driven lengthwise and in a horizontal plane due to friction between the two lower 2 and upper 2 rollers since these rollers, as already mentioned, are equipped with rotation means such as electric, hydraulic or other motor elements.

As shown in FIG. 1, the machine further includes two side rollers 21, 22 disposed symmetrically on either side of the central rollers 1, 2. The side rollers 21, 22 are mobile in an oblique direction relative to the plane formed by the two central rollers 1, 2.

Two pairs of hydraulic cylinders 23, 24 (only one of the cylinders of each pair is shown in FIG. 1) which are each attached to the bearing of one of the side rollers 21, 22 are adapted for positioning these rollers in parallel with respect to the pair of central rollers 1, 2. The assembly of the four rollers 1, 2, 21, 22 is, as already mentioned, inscribed inside an upper frame a portion 25 of which is shown in FIG. 2, this support frame being provided with the slides necessary for the movements of the rollers 1, 2, 21, 22 controlled by cylinders 13, 14, 23, 24.

As already mentioned, this frame is moreover provided with a tilting bearing 3 (see FIG. 2) articulated about an axis 25a and controlled by the double action cylinder 15. This tilting bearing assembly is located in the frame axis and therefore is adapted for disengaging the sliding bearing 6a housed inside the tilting bearing 3 of the upper roller 1 so as to extract from the central roller 1, 2 assembly a rolled metal sheet entirely closed. The double action cylinder 5 of the bearing 4 attached by one of its ends 5a to the machine frame is adapted for tilting the whole of the upper central roller 1 about an axis 26 shown schematically in FIG. 2 so as to make the disengagement manoeuvre of a closed rolled metal sheet easier once the bearing 3 has been tiled by the cylinder 15. The end bearings of each of the central rollers 1, 2 are slidingly mounted and are formed with swivels for possibly slanting them relative to the horizontal.

The metal sheet 20 which is nipped between the two central rollers 1, 2 is bent by any one of the side rollers 21, 22 which are pushed by the pairs of cylinders 23, 24. A pushing effort F1 (FIG. 1) of the side rollers used, in the prelsent case the roller 21, generated by said operating jacks, creates a flexing moment the value of which is Fxd and bends therefore the metal sheet 20 where central rollers 1, 2 are housing it. The rotation in opposite directions of the central rollers 1, 2 nipping the metal sheet 20 drives the metal sheet 20 in a determined direction. After bending, the holding in position of the side roller used (roller 21), in association with the rotation of the two central rollers 1, 2, produces a theoretical rolling radius R, which is a function of a position x of the side roller 21.

As already mentioned, the lateral position of the roller 21 providing for the theoretical radius is in fact generally controlled by the operator.

However, and due to the non-homogneities of the metal to be rolled, the metal sheet thickness variations due to laminating errors, the modification of the metal characteristics during rolling, the fact that the work is carried out beyond the material resilient limit, it results that the radius really obtained is not the one required and furthermore a relatively large ovalization (difference between maximum radius and minimum radius actually rolled) is obtained, it being necessary to make up for such an ovalization by many local "passes", made at a low speed.

Nevertheless, the final product remains with non negligible faults.

An originality of the automatically controlled system of the present invention consists in using probes 30a, 30b attached to the frame, not shown, on either side of the lower central roller 2, for example between the central roller 2 and the side rollers 21, 22. Of course, several probes 30a, 30b placed along the width of the metal sheet to be rolled can also be used.

For simplification purposes, this description will now be made with a single probe 30a and a single probe 30b placed at half the width of the metal sheet between the lower roller 1 and each of the side rollers 21, 22. These probes are made for example of hydraulically controlled cylinders 31, 32 carrying a small wheel 33, 34 at their stem end. The cylinders 31, 32 can be displaced upwardly or downwardly, either for placing the small wheels 33, 34 in engagement with the metal sheet outside, or to be retracted from the metal sheet.

The position in altitude of the probes 30a, 30b is registered by means of sensors (of a digital or analog type) 35a, 35b.

When the small wheels 34,34 are in engagement with the metal sheet 20, the oil pressure in maintained in the "positioning" direction so that the small wheel 33 or 34 remains in engagement with the metal sheet 20 at any moment whatever the irregularities (bumps, hollows, out-of-round) of metal sheet 20.

The contact effort of the small wheels 33, 34 on the metal sheet 20 is calculated so that the resultant metal sheet deformation is negligible (a few kilograms).

The first rolling pass is made with the side roller 21 being in a fixed position $X_1$ corresponding to a given radius $R_1$, the radius being larger than the required final radius $R_f$. The probes 30a, 30b are then retracted.

This pass being terminated, the side roller used is retracted so as to free the bent metal sheet, which however remains entrapped between the central rollers 1, 2. The two probes 30a, 30b are placed in engagement with the metal sheet outer face, and the metal sheet is moved along by the driving motors 7, 7a. In the same manner as a theoretical radius $R_t$ corresponds to any position X of the side roller, a real radius $R_r$ corresponds to any position z of the probe (since the metal sheet 20 is no more subjected to an effort). Under such conditions, one registers, on all the metal sheet length, the value of the instantaneous bending radius $R_i$.

The deviations of $R_i$ relative to the required bending radius are calculated from their measurement and stored in a memory and are therefore used in a future passto servo-control the position $x_2$ of the side roller (or rollers) 21 and 22 so as to reduce or cancel the registered geometrical variations.

For the next pass, a new position $x_2$ of the side roller in consideration is therefore determined for obtaining a new theoretical radius $R_2$ smaller than $R_1$. At any moment during the metal sheet movement, there is added to the value of $x_2$ thus established the deviations corresponding to the values stored during the first pass by means of the probes, weighted by a certain coefficient. The second pass is carried out by servo-controlling the position of the side roller and a new surveying of the real profile is made by the probes. The instantaneous variations which will be used for correcting the roller position during the third pass are then once again registered, and so on until the final radius is obtained.

The servo-control of the side rollers 21, 22 is made in the following manner:

(1) to each one of the rollers 21, 22 are respectively associated two sensors 40a, 40b and 41a, 41b representing the position x of each one of the rollers 21, 22. This arrangement enables obtaining in a precise manner the horizontality of the rollers;

(2) as a function of the machine geometrical data and of the number n of the pass to be effected, a digital computer 50 (FIG. 3) calculates the theoretical radius $R_n$ to be obtained. This calculation is effected according to a so called "convergence" law of decreasing exponential form, enabling to come nearer the final radius $R_f$ to be rolled as a function of the pass number.

It is possible to fix the number n of passes by using the convergence law.

Figure 3:
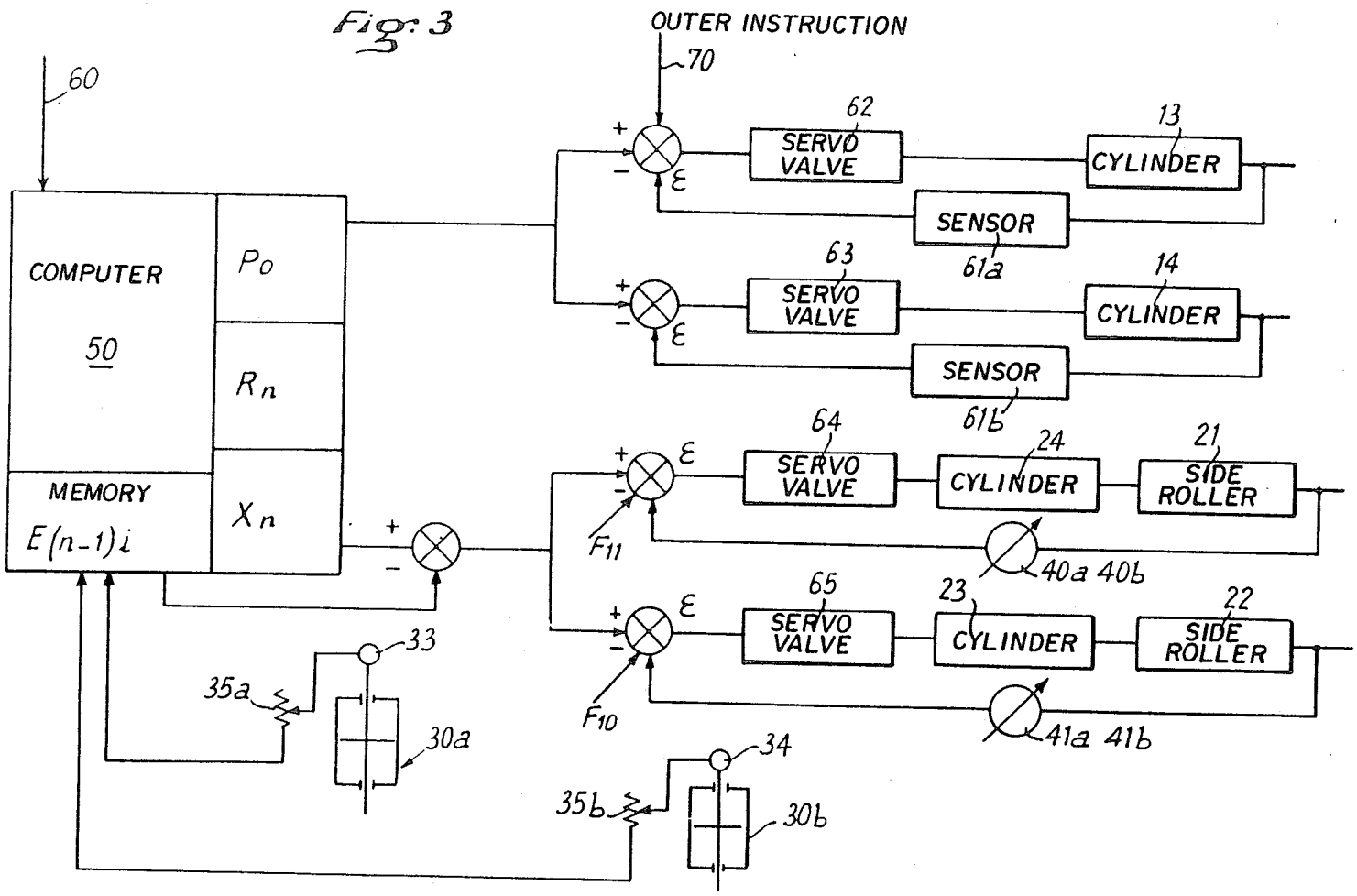
FIG. 3 is a diagram of the machine automatic control.

The metal sheet characteristics, the number of passes, the final radius and the tolerances are introduced in the computer 50 via on input 60 (see FIG. 3);

(3) according to a mathematic law fixed by the machine and accessories geometry, the computer 50 establishes then, for each theoretical radius $R_n$ to be obtained, the corresponding theoretically fixed position instruction $X_n$ for the roller;

(4) during the rolling of pass n, a variable correction instruction $\alpha E(n-1)i$ is superimposed to the main instruction $X_n$, representing, for each point of the metal sheet 20 profile, a portion of the stored value $E(n-1)i$, corresponding to the deviation registered during the preceding pass $(n-1)$ by the probes between the theoretical radius $R(n-1)$ and the real radius $R(n-1)i$. This deviation is a function of the position i of the metal sheet 20 with respect to the position where the metal sheet 20 is nipped;

(5) the values of $E(n-1)i$ correspond at all points to the rolled profile, to the arithmetic average value of the variations between the theoretical radius $R(n-1)i$. These variations are calculated by the computer 50 by using values $R(n-1)i_1$ and $R(n-1)i_2$, measured simultaneously by the two probes 30a, 30b along the whole metal sheet. This arrangement allows limiting any measurement error due to metal sheet irregular movements during the "off-load" translation, and/or to the effect of the weight proper of the metal sheet 20 the center of gravity of which moves during the translation.

These variations are then stored. As hereabove mentioned, the registered values of $E(n-1)$ are transformed into correction instructions $\alpha E(n-1)i$ in order to take in account the convergency law, the number of the pass and the machine geometry;

(6) likewise, the measurements effected by the two probes 30a, 30b during the pass n allow calculating by simple geometrical relations the instantaneous radius at any point and the corresponding real average radius $R(n)i$;

(7) the comparison between the final radius $R_f$ entered as a data in the computer 50 and the radius $R(n)i$ stops the convergence cycle when the deviation is less than a previously fixed value (tolerance admitted on the radius);

(8) likewise, the servo-control cycle of the rollers is stopped when the value $E(n)$, representing the arithmetic average of values $E(n)i$ along the sheet, is less than a reference value previously fixed (ovalization tolerance). $E(n)$ represents the divergence between $R(n)$ and $R(n)i$ during pass n.

During rolling, the realization of a cylinder which is not warped necessitates a constant and uniform nipping effort on the metal sheet on the whole length thereof.

Where this effort is not uniform or badly determined, it is a cone or a drum which is rolled, or the metal sheet is formed as a laminate.

The nipping effort is a function of the thickness of the metal sheet to be rolled, of its width and of the steel quality.

The adjustment of this effort was at present, as already mentioned, made by means of safety valves controlled by the operator, generally on a separate manner on each side.

This disposition can lead to errors in many cases (different settings between the two valves, bad adjustment relative to the metal sheet characteristics, etc.) which are reflected by the hereabovementioned defects.

The proposed machine includes therefore a servo-control of the nipping effort realized in the following manner.

The mobile lower central roller 2 is equipped with two cylinders 13 and 14. Each cylinder jack section which is subjected to the pressure is fitted out with a pressure sensor 61a, 61b (see FIG. 2).

As a function of the mechanical characteristics of the metal sheet which are entered as data into the computer 50, the computer 50 establishes from simple relations a pressure instruction $P_o$ which is an image of the nipping effort. This instruction is compared to the real pressure $P_r$ measured by the sensor 61a or 61b.

The deviation between $P_o$ and $P_r$ allows controlling a servo-valve 62 or 63 feeding cylinder 13 or 14 or exhausting the oil under pressure for maintaining the pressure at a constant level.

One of the cylinders can also receive an outer additional instruction 70 allowing for example straightening back a metal sheet rolled in the shape of a cone or warped. This additional instruction enables reducing or increasing the pressure of the circuit in consideration with respect to the pressure calculated.

This machine can also roll cones by an inclination of the bending side roller with respect to the horizontal. For so doing, the position instructions $x_n$ imposed to each cylinder of a same roller are different, and result from a simple mathematical calculation made as a function of the machine geometrical data and carried out by the computer.

A manual control modifying one of the two position instructions $x_n$ of the two control cylinders of a same roller gives also to the operator the possibility of making cones independently from the computer (arrows $F_{10}$ and $F_{11}$—FIG. 3).

What is claimed is:

1. An automatically controlled machine for rolling metal sheets comprising:

at least two central rollers;

means for rotating and adjustably driving said at least two central rollers with a metal sheet passing therebetween;

side rollers placed on each side of said central rollers;

positioning means for positioning said side rollers and including positioning cylinders (23, 24);

a first set of sensors (40*a*, 40*b*, 41*a*, 1*b*) connected to said side rollers and to a computer for registering a position of said side rollers;

at least two probes positioned symmetrically with respect to the central rollers and one probe disposed between said central rollers and each of said side rollers, said probe being connected to a second set of sensors and comprising a cylinder having a stem provided at a distal end thereof with a rotating wheel in contact with a metal sheet passing out of the central rollers so as to obtain a position of said probes by means of said second set of sensors;

means for rolling in a continuous manner; and said second set of sensors being connected to said computer for providing information compared to instructions from the computer in order to correctly position the side rollers for suitably rolling the metal sheet to a required radius within given tolerances.

2. The machine as set forth in claim 1, wherein said central rollers include a lower roller mounted in bearings, and locating means for sliding said lower roller vertically for obtaining a constant and uniform effort from the instructions from the said computer, said locating means comprising locating cylinders (13,14).

3. The machine according to claim 1, wherein said computer comprises at least one memory for registration of radius and roundness tolerances of said metal sheet.

4. The machine according to claim 1, wherein said computer comprises means for effecting a number of work passes.

5. The machine according to claim 1, wherein during the continuous rolling, each successive radius of said metal sheet is calculated according to a decreasing exponential convergence law, roundness corrections being carried out during said rolling.

* * * * *